United States Patent [19]

Kirchner, Jr. et al.

[11] 4,446,590

[45] May 8, 1984

[54] PAINT ROLLER CLEANER

[76] Inventors: Charles H. Kirchner, Jr., 2013 Wrenwood Dr., Huntsville, Ala. 35803; Thomas K. McDonald, 2200 Gladstone Dr., Huntsville, Ala. 35811

[21] Appl. No.: 352,319

[22] Filed: Feb. 25, 1982

[51] Int. Cl.[3] ..... B08B 3/02

[52] U.S. Cl. ..... 15/302; 15/308; 134/139; 134/149

[58] Field of Search ..... 15/302, 308; 134/138, 134/139, 149

[56] References Cited

U.S. PATENT DOCUMENTS

| | | | |
|---|---|---|---|
| 2,773,274 | 12/1956 | Beech | 134/149 X |
| 3,755,840 | 9/1973 | Barger | 134/138 X |
| 4,130,124 | 12/1978 | Sherwin | 134/138 |
| 4,294,272 | 10/1981 | Klaiber | 134/138 |
| 4,377,175 | 3/1983 | Fritz | 134/138 |

*Primary Examiner*—Chris K. Moore

*Attorney, Agent, or Firm*—C. A. Phillips

[57] ABSTRACT

A paint roller cleaner wherein a paint roller is pivotally mounted within a housing, and an in-line series of jets of a water-detergent solution are directed at and along the paint roller. The line of jets is positionable so that they will both effect rotation of the roller and wash paint out of it. Cleaning is aided by the irregular surface of a scrubbing member which engages the paint roller as it is being sprayed with liquid and rotated. After the washing operation, a series of in-line jets of air are directed at the roller, and these jets are positioned at an angle to both rotate and dry the paint roller. The detergent solution is injected into the water by means of a venturi tube positioned in the path of the flow of the water prior to its ejection by the jets.

10 Claims, 8 Drawing Figures

PAINT ROLLER CLEANER

TECHNICAL FIELD

This invention relates generally to devices for cleaning paint rollers, and particularly to one wherein a series of jets of water are directed against the paint roller.

BACKGROUND ART

The idea of spraying a paint roller with a stream of water to clean it is not new. One such device illustrative of this technique is shown and described in U.S. Pat. No. 3,428,060. In this patent, a paint roller is pivotally mounted within an enclosure, and in-line jets of water from a pressurized manifold are directed against the paint roller. The applicants have found, however, that unless the paint residue in the roller to be cleaned is still in a quite liquid state, this type of device is often not effective in cleaning a paint roller.

Accordingly, it is an object of this invention to provide an improved paint roller cleaner which is effective in cleaning paint rollers with fairly viscus particles of residue, a state which is often encountered by virtue of typical delays in effecting cleaning.

SUMMARY OF THE INVENTION

In accordance with this invention, a paint roller is pivotally positioned within a support frame, which frame may incorporate a partial enclosure. A liquid pressurized manifold having a set of in-line openings is positioned parallel to and along the paint roller and spaced a short distance from it. The manifold is rotationally positionable so that liquid flowing from the openings is directed in a direction which both cleans and rotates the paint roller.

As one feature of this invention, a scrubbing member having a roughened or nippled surface is in engagement with the paint roller, and it dislodges particles of paint embedded in the pad-like surface of the paint roller.

As another feature of the invention, a water passageway to the manifold contains a venturi tube, and a cleaning agent, such as a liquid detergent, is fed to the venturi tube, which then injects the cleaning agent into the water stream. This enhances the cleaning action.

DETAILED DESCRIPTION OF THE DRAWINGS

Figure 1:
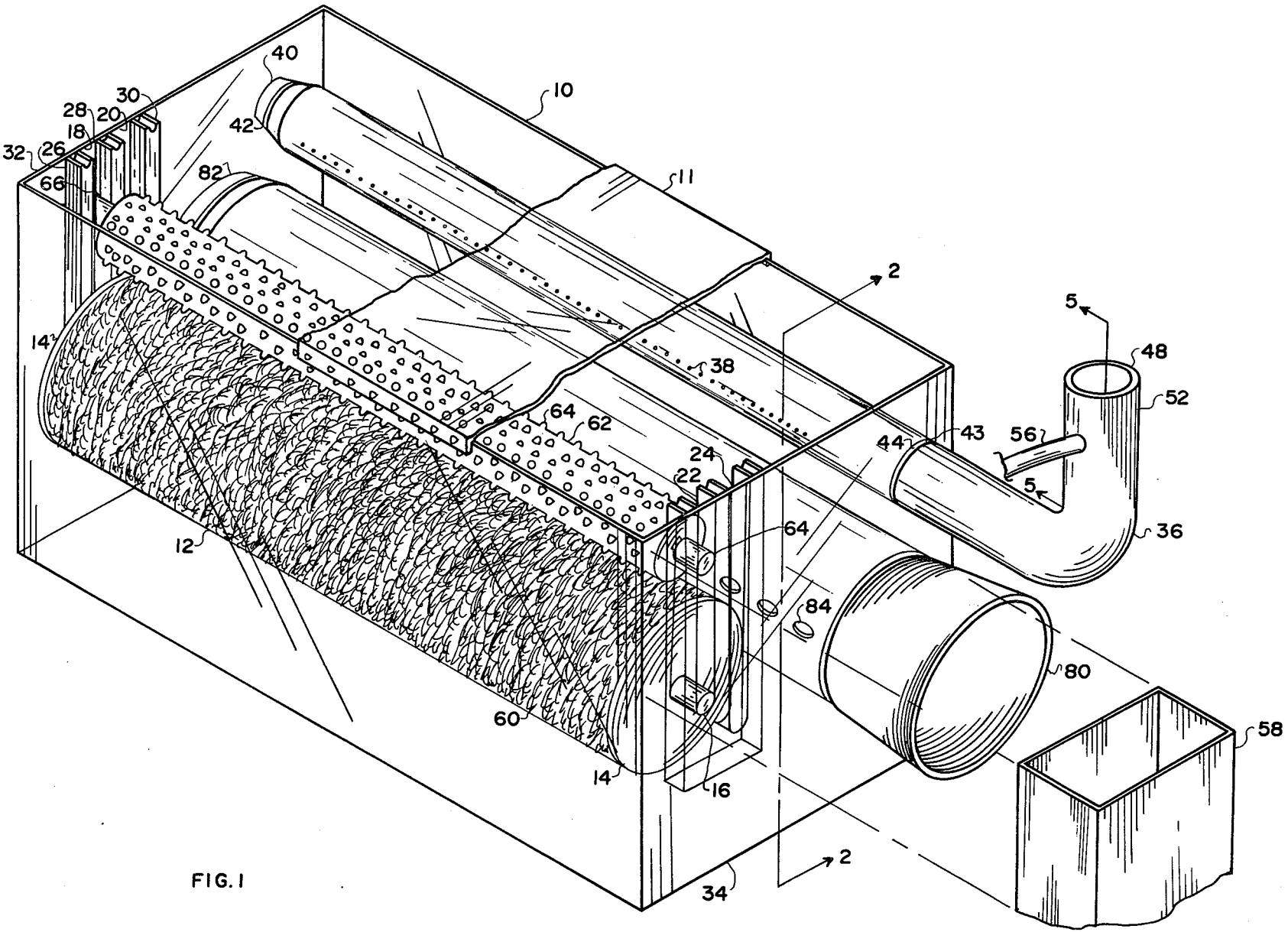
FIG. 1 is a perspective view of a paint roller cleaner as contemplated by this invention.
Figure 5:
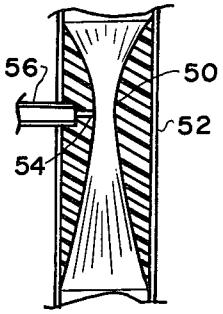
FIG. 5 is a sectional view as seen along line 5—5 of FIG. 1.

Referring to FIGS. 1–6 of the drawings, and first to FIG. 1, frame and enclosure 10, having a removable top 11, is constructed of a transparent plastic material, which is particularly of advantage in that the operation of the unit may be, to an extent, observed. A paint roller 12 is removably positioned within enclosure 10 and supported by roller holding end members 14 (FIG. 6) having axles 16 supportable in one or the other of two pairs of vertical slots, one pair consisting of slots 18 and 20, and the other pair, parallel with the first pair, consisting of slots 22 and 24. These slots are formed by sides of pillars 26, 28, and 30 on each end of end walls 32 and 34.

Figure 4:
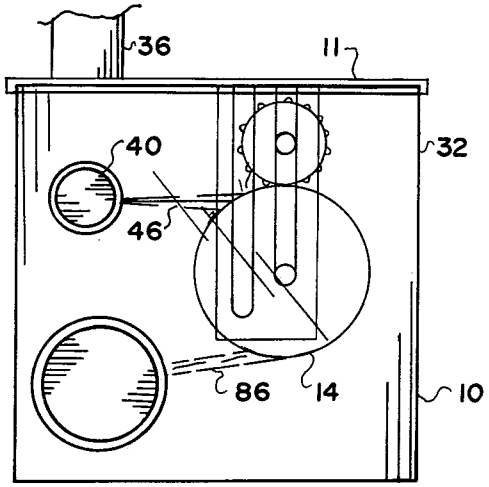
FIG. 4 is a left end view of the embodiment of the invention illustrated in FIG. 1.
Figure 3:
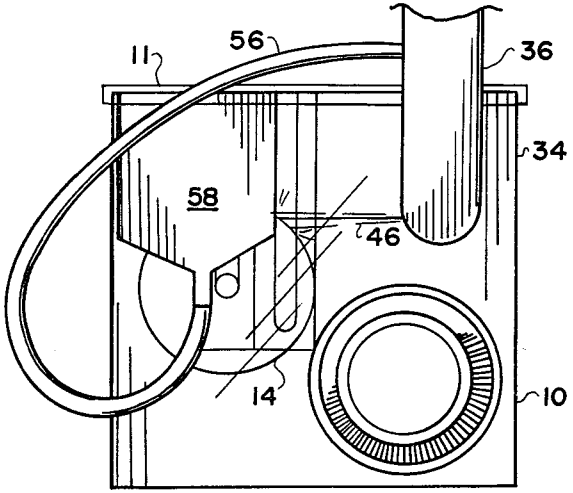
FIG. 3 is a right end view of the embodiment of the invention illustrated in FIG. 1.
Figure 6:
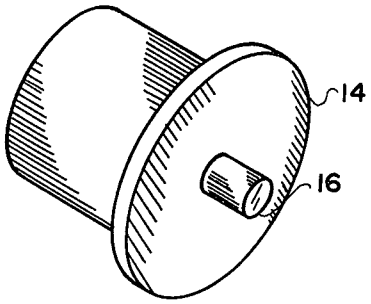
FIG. 6 is a perspective view of a roller holding end member.
Figure 8:
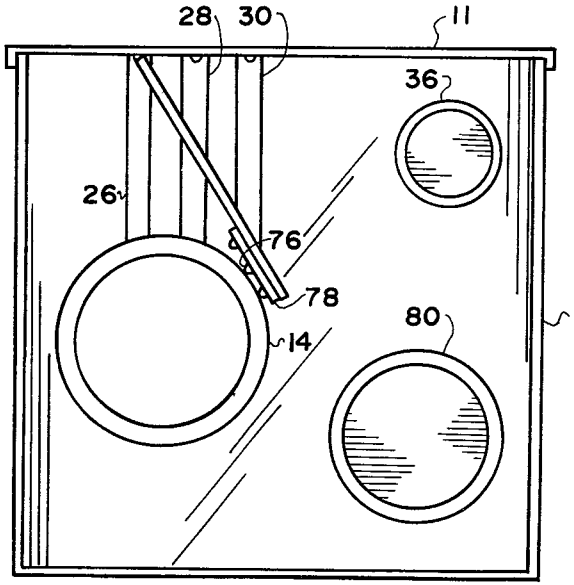
FIG. 8 is a sectional view as seen along line 8—8 of FIG. 7.

A liquid supply manifold 36, typically in the form of a section of plastic pipe material, is positioned parallel to paint roller 12 and to one side and above paint roller 12. It contains in-line openings 38 which extend essentially from one end to the other of manifold 36 and over a length essentially corresponding to the effective length of paint roller 12. End region 40 of manifold 36 is tapered as shown to enable it to be removably frictionally locked in opening 42 of end wall 32 and contains a key slot to limit rotation angle of the spray. The opposite end region 43 of manifold 36 is of a constant diameter, and it simply frictionally fits within an opening 44 in end wall 34. By this combination of supports, manifold 36 may be moved to the right and loosened, then rotated to a desired angle for positioning of openings 38, then moved to the left and frictionally held at this angle by end openings 42 and 44 in end walls 32 and 34. This angle is selected so that an in-line stream of pressurized water from openings 38 will be directed at a region of paint roller 12, such as shown in FIG. 4 by stream 46, wherein paint roller 12 is both washed by the stream and rotated by the impact of it.

The water under pressure in manifold 36 is supplied through inlet end 48 by conventional means (not shown). Typically, such means would consist of a simple garden hose connection. A venturi tube 50 (FIG. 5) is formed within an end region 52 of the portion of manifold 36 extending outside of enclosure 10, and it includes an injection opening 54 coupled to a feed tube 56. Feed tube 56 connects to a liquid or detergent reservoir 58 (FIG. 3), and thus with the application of water under pressure through opening 48 and through venturi tube 50, soap or detergent is drawn from reservoir 58, injected into the water stream flowing into manifold 36. The soap or detergent mixture then exits through openings 38 in manifold 36 as a pressurized stream as described. As noted above, this stream (shown) is directed as an off-axis stream with respect to the axis of rotation of paint roller 12, and thus paint roller 12 is rotated by the stream, and at the same time it is saturated by the stream. Recognizing that paint rollers vary in diameter, in order to effectively position a roller to maintain the best relationship between manifold 36 and a paint roller, one or the other of the paints of the paint roller holding slots (18 and 20 or 22 and 24) would be employed.

As suggested above, it is not uncommon that some significant time elapses after painting with a roller until a painter gets around to cleaning it. Thus, by that time, residual paint in the roller may have started to congeal or even harden. To generally solve this problem, and to enhance cleaning action, means are provided to, in effect, exercise the paint holding pad surface region 60 of the paint roller at the same time the paint roller is being sprayed by the liquid cleaning stream from manifold 36. One illustration of such a means is shown in FIG. 1 wherein a scrubbing roller 62 having an irregular nippled surface 64 engages the surface region 60 of paint roller 12. Scrubbing roller 62 has a pair of oppositely positioned stub axles 64 and 66 by which it is rotably supported in one pair of the paint roller holding slots (slots 18 and 20 or slots 22 and 24). Thus, scrubbing roller 62 rests on paint roller 12 by gravity under its own weight, and its weight (two to six ounces) is such as to cause its irregular surface to effect an in-and-out movement of paint roller 12, and thereby agitate loose paint particles and remove them from the paint roller. Accordingly, by the combination of the device described, a most effective paint roller cleaning device is provided.

Figure 7:
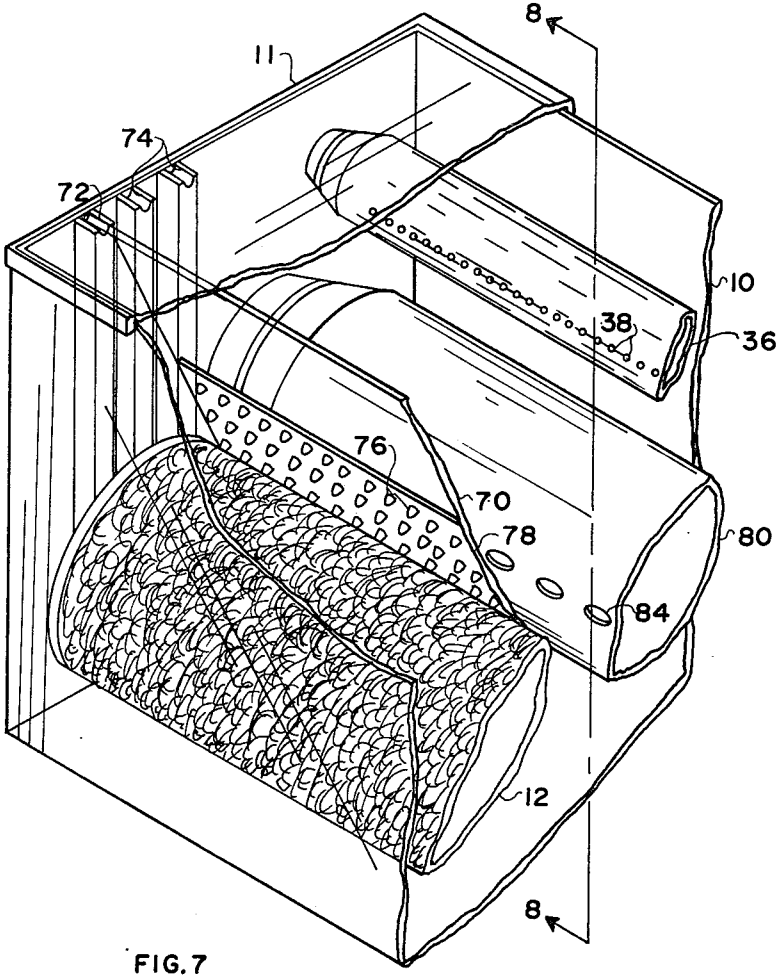
FIG. 7 is a partially broken, perspective view illustrating a modified scrubbing member.

FIG. 7 illustrates an alternate form of scrubbing system wherein a scrubbing plate member 70 is substituted for the rotor type in FIG. 1. Scrubbing plate member 70 has a pair of supporting extensions 72 at each end (only one is shown) which rest in indented regions 74 of one of pillars 26, 28, or 30. As these supporting ends are the same at both ends of the scrubbing plate member, FIG. 7 shows only one end configuration. Scrubbing plate member 70 has a plurality of knobs or nipples 76 on a plate region 78 which, by virtue of the weight of plate region 78, effects sufficient force of engagement (two to six ounces) by the knobs or nippled surface to effect a scrubbing action on the surface of a paint roller sufficient to free most congealed or solid particles of paint within the pad paint holding region of the paint roller. Typically, scrubbing plate member 70 is formed of a rigid plastic material wherein the scrubbing plate has the sufficient mass to enable the knobs or nipples to penetrate into or depress the surface of the paint roller.

Figure 2:
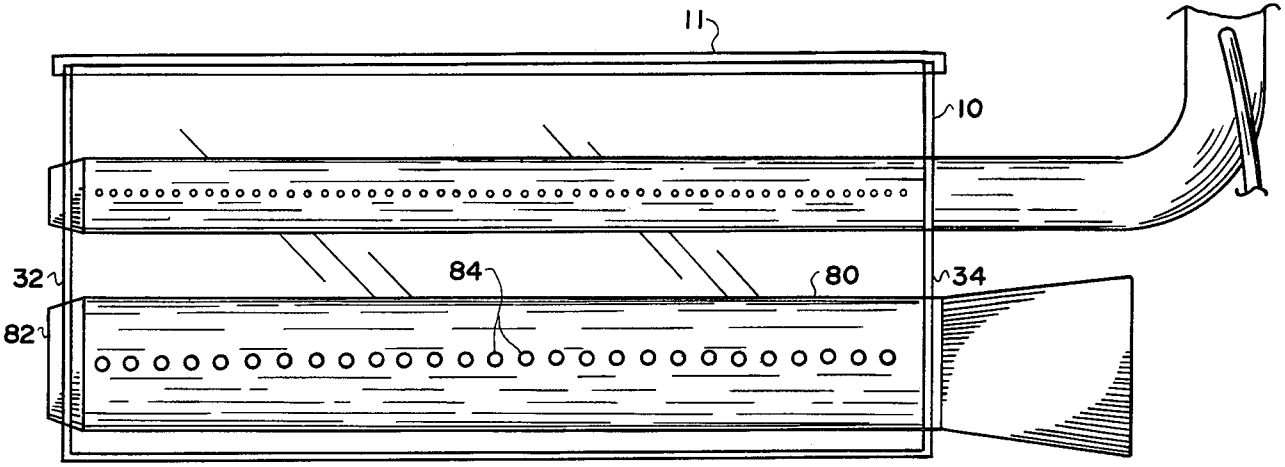
FIG. 2 is a sectional view taken along line 2—2 of FIG. 1.

As a still further feature of this invention, drying means are provided to dry a paint roller after it has been cleaned as described. It employs an air manifold 80 having a series of openings as illustrated in FIG. 2. As in the case of manifold 36, manifold 80 is typically constructed of a rigid plastic material which frictionally fits into end walls 32 and 34 of enclosure 10, the end region 82 of manifold 80 being tapered to enable a locking frictional fit at a desired angle and containing a key slot to limit rotation angle of the spray. In this fashion, the position of a line of openings 84 in manifold 80 may be selected wherein a stream of air 86 (FIG. 4) against roller 12 is at such an angle as to rotate paint roller 12 and, at the same time, dry it all over.

From the foregoing, it is to be appreciated that by means of the present invention, a most effective and yet inexpensive cleaning device for paint rollers is provided.

We claim:

1. A paint roller cleaner comprising:

a frame;

support means for removably and pivotally supporting ends of a paint roller, said roller including two spindles positionable within and on said frame and along an axis of a given direction;

a longitudinal manifold supported on said frame and extending generally parallel with said axis and spaced therefrom, and said manifold having a series of openings along a longitudinal side of said manifold facing in a direction which will be intercepted by an off-axis line of position on the paint roller as positioned in said support means;

mounting means for mounting said longitudinal manifold on said frame, and including means for adjustably rotating said longitudinal manifold with respect to said frame about a longitudinal axis;

supply means for supplying a flow of water under pressure to said longitudinal manifold; and positioning means for variably positioning said support means with respect to said longitudinal manifold.

2. A paint roller cleaner as set forth in claim 1 further comprising second supply means for supplying a water soluble cleaning agent to said flow of water, whereby a mixture of water and cleaning agent is supplied to said longitudinal manifold.

3. A paint roller cleaner as set forth in claim 2 wherein said cleaning agent is a liquid cleaning agent, and said second supply means includes a venturi through which said flow of water flows, and means for supplying said cleaning agent to said venturi.

4. A paint roller cleaner as set forth in claim 1 including scrubbing means supported by said frame and having an irregular surface engageable with a paint roller when supported by said support means.

5. A paint roller cleaner as set forth in claim 4 wherein said scrubbing means comprises a pivotally supported roller having an irregular surface engageable with and rotatable with a paint roller when supported in said support means.

6. A paint roller cleaner as set forth in claim 4 wherein said scrubbing means comprises a pivotally supported plate having an irregular surface in engagement with said roller when supported in said support means.

7. A paint roller cleaner as set forth in claim 1 further comprising:

a second longitudinal manifold parallel with and spaced from said first manifold, and said second longitudinal manifold having a series of openings on a longitudinal side of said second manifold, and which openings face in a direction which would be intercepted by an off-axis region of a paint roller installed in said support means;

second supply means for supplying air under pressure to said second manifold.

8. A paint roller cleaner as set forth in claim 7 including mounting means for supporting said second longitudinal manifold on said frame, including means for adjustably rotating, with respect to said frame, said second longitudinal manifold about its longitudinal axis, whereby the direction of air from said second longitudinal manifold from said openings is variable.

9. A paint roller cleaner comprising:

a frame;

support means for removably and pivotally supporting ends of a paint roller having opposite end spindles, said support means comprising at least two pairs of spaced slots, and wherein a roller is supportable by its ends, alternately, by one of said pairs or the other, a longitudinal manifold supported on said frame and extending generally parallel with said axis and spaced therefrom, and said manifold having a series of openings along a longitudinal side of said manifold facing in a direction which will be intercepted by an off-axis line of position on the paint roller as positioned in said support means;

mounting means for mounting said longitudinal manifold on said frame, and including means for adjustably rotating said longitudinal manifold with respect to said frame about a longitudinal axis; and supply means for supplying a flow of water under pressure to said longitudinal manifold.

10. A paint roller cleaner comprising:

a frame;

support means for removably and pivotally supporting an elongated paint roller on said frame, including a pair of like stub axles, one stub axle being positioned in each opposite end of said roller, and each said stub axle being supported within and on said frame and along an axis of a given direction;

a longitudinal manifold supported on said frame and extending generally parallel with said axis and spaced therefrom, and said manifold having a series of openings along a longitudinal side of said manifold facing in a direction which will be intercepted by an off axis line of position of said paint roller as positioned in said support means;

mounting means including a pair of spaced openings in said frame for mounting said longitudinal manifold on said frame, and including means for adjustably rotating said longitudinal manifold in said openings with respect to said frame about a longitudinal axis, and means including a tapered end region of said manifold for effecting a frictional engagement within said spaced openings between said frame and said manifold for maintaining said manifold in a selected position; and supply means for supplying a flow of water under pressure to said longitudinal manifold.

* * * * *